US006098439A

United States Patent [19]

Lecrivain

[11] Patent Number: 6,098,439

[45] Date of Patent: Aug. 8, 2000

[54] DEVICE FOR CHANGING THE ROLLS AND/OR THE INTERMEDIATE ROLLS IN A ROLL STAND AND STORAGE RACK FOR SUCH A DEVICE

[75] Inventor: Alain Lecrivain, Combs la Ville, France

[73] Assignee: Kvaerner Metals Clecim, Paris La Defense, France

[21] Appl. No.: 09/168,917

[22] Filed: Oct. 9, 1998

[30] Foreign Application Priority Data

Oct. 10, 1997 [FR] France ..... 97 125705

[51] Int. Cl.[7] ..... B21B 31/07

[52] U.S. Cl. ..... 72/239

[58] Field of Search ..... 72/237, 238, 239

[56] References Cited

U.S. PATENT DOCUMENTS

| | | | |
|---|---|---|---|
| 3,866,455 | 2/1975 | Petros . | |
| 4,270,377 | 6/1981 | Verbickas et al. | 72/242 |
| 4,435,970 | 3/1984 | Sekiya | 72/239 |
| 4,771,626 | 9/1988 | Ichida et al. . | |
| 5,007,273 | 4/1991 | Kummerhoff | 72/243.2 |

FOREIGN PATENT DOCUMENTS 0 684 089 11/1995 European Pat. Off. .

OTHER PUBLICATIONS

Patent Abstracts of Japan, vol. 003, No. 091, Aug. 3, 1979 & JP 54–068754, Hitachi, Ltd., Jun. 2, 1979.

Patent Abstracts of Japan, vol. 015, No. 222, Jun. 6, 1991 & JP 03–066405, Hitachi, Ltd., Mar. 22, 1991.

Patent Abstracts of Japan, vol. 003, No. 118, Oct. 4, 1979 & JP 54–096457, Hitachi, Ltd., Jul. 30, 1979.

*Primary Examiner*—Rodney A. Butler

*Attorney, Agent, or Firm*—Arent Fox Kintner Plotkin & Kahn

[57] ABSTRACT

A device and method for changing rolls in a roll stand. Each stand includes two working rolls, each having a backing up assembly including at least one intermediate roll. An adjustment structure is provided for adjusting levels in relation to the axes of each of the rolls with respect to the stand and for setting forth four levels of disassembly, respectively of both working rolls and both intermediate rolls. Two pairs of rails are provided parallel to the axes of the rolls arranged on the stand at two constant levels each at a level of disassembly and carrying sliding carrying members for removal of the corresponding intermediate roll. A handling device is placed on one side of the stand and includes at least one handling and guiding chassis carrying two pairs of rails aligned respectively with both pairs of rails on the stand. At least one extractor device is mounted to slide at a constant level on the guiding chassis. A carrying member is mounted on the extractor device to pick up each working roll with the level of the carrying member being adjustable. A removable mechanism is provided on the extractor device for hooking each of the intermediate rolls. The removable mechanism is actuated selectively.

18 Claims, 7 Drawing Sheets

DEVICE FOR CHANGING THE ROLLS AND/OR THE INTERMEDIATE ROLLS IN A ROLL STAND AND STORAGE RACK FOR SUCH A DEVICE

The invention relates to a device for changing the rolls in a roll stand and applies especially to sexto or 'Z-High' type roll stand in which intermediate rolls are interposed between the working rolls and the backing-up rolls.

We know that a mill comprises, generally, a fixed roll stand with two spaced stanchions between which are arranged several superimposed rolls with parallel axes, respectively two working rolls delineating an air gap for the passage of the product and one or several backing-up rolls, whereas a clamping load is applied between the rolls by mechanic or hydraulic jacks.

To allow the application of the clamping load and the adjustment of the air gap, each roll is, generally, carried, at both its ends, by two bearings accommodated in supporting blocks, called chocks, mounted to slide along guiding faces provided, respectively on both stanchions of the roll stand and parallel to a clamping plane passing through the axes of the working rolls.

In quarto-type mills, each working roll is connected to a backing-up roll.

In sexto-type mils, an intermediate roll is interposed between each working roll and one backing-up roll.

Besides, when the diameter of the working rolls must be reduced particularly, it is advantageous to use so-called 'multiroll' mills in which each working roll is connected to a set of backing-up rolls provided on either side of the clamping plane passing through the axes of the working rolls.

To ensure lateral holding of each working roll without increasing gradually the number of backing-up rolls, it has also been suggested simply to improve the sexto-type mill while connecting to each working roll two sets of lateral carrying rollers arranged respectively, on either side of the working roll and each comprising a roller extending laterally along the working roll and resting, for its own part, on at least two rollers.

In such a configuration, called 'Z-High' and described for instance in the document U.S. Pat. No. 4,270,377, each lateral carrying assembly is composed of at least three connected rollers, mounted on a chassis arranged in the space delineated between the passage plane of the milled band, the working roll and the intermediate roll and carried by articulated arms, respectively on both chocks of the intermediate roll.

It is necessary, in a roll mill, to replace the rolls periodically, particularly the working rolls, because of their wear or in order to suit the milling programme.

Normally, the rolling process must be stopped during these operations and this downtime should be reduced as much as possible.

Moreover, in modern milling units performing continuous rolling, the assembly and the replacement of the rolls must often be conducted while the metallic band is still maintained inside the mill and may therefore be damaged during the replacement operations.

Besides, the roll to be replaced and the new roll may be damaged by contacting the other rolls or the fixed parts of the roll stand. It is therefore advisable that the rolls are guided with accuracy with respect to the roll stand during displacement.

In order to reduce the replacement time as well as the risks of damaging the rolls, it is advantageous to perform these operations in automatic or semi-automatic mode, using a replacement device comprising, often, an extractor member parided with removable means for hooking the rolls and mounted as translation-mobile along a direction parallel to the axes of the rolls, inside a lateral reception chassis, fitted with means for supporting and for guiding the rolls.

To ensure accurate guiding, each roll is, generally, carried by two chocks which are provided with castors running on aligned fixed rails provided respectively on the roll stand and on the reception chassis.

Besides, it is advantageous to use at least two lateral chassis mounted side by side on an auxiliary carriage, movable perpendicular to the axes of the rolls in order to place one of both chassis in a replacement position for which the rails of the chassis are aligned with the fixed rails of the roll stand.

Thus, new rolls can be placed aforehand on a chassis of the auxiliary carriage, whereas the other chassis remains free for used rolls. The latter are therefore extracted from the roll stand to be placed on the auxiliary carriage and, by moving the latter, the new rolls are brought into the axis of the roll stand and inserted in the latter.

Such an arrangement called 'side-shifter' is described for instance in the document EP-A-0.112.981.

In such a configuration, the extraction or the insertion of the rolls, with respect to the roll stand, is generally performed using the same extraction member which remains permanently in the axis of the roll stand. This extractor must therefore be released from the grip of the lateral carriage during the translation operation of this carriage parallel to the milling direction in order to avoid any interference. This contributes to increase the time necessary to changing the rolls.

However, when the diameter of the working rolls is too small, it is difficult to connect chocks to the former.

Each working roll is thus fitted, at both its axial extremities, with extensions shaped like cylindrical journals resting at their extremities on axial stops for holding in position the roll during the milling process.

In order to extract from the roll stand or to insert into the former, such a working roll free of chocks, it is not possible to make it slide on rails any longer.

Generally, a pick-up device is used, composed of a control rod hanging from a rolling bridge and fitted, at its end, with a cylindrical recess, called 'barrel'. Using the rolling bridge, the rod is placed in the alignment of the roll to be replaced and the 'barrel' is engaged on the journal. The rod is connected to a counterweight enabling to balance the weight of the roll which can thus be raised and removed from the roll stand.

Because of the use of a rolling bridge, such a device is little accurate and it is therefore necessary, to avoid any risk of damage, that the roll to be replaced is relatively isolated from the other rolls and from the fixed sections of the roll stand.

It has already been suggested in the document U.S. Pat. No. 3,866,465, to have a 'barrel' pick-up member on a 'side-shifter'-type replacement device.

According to this well-known layout, the extractor device is installed, as usual, on a carriage movable on fixed rails, parallel to the axes of the rolls, and co-operating with two auxiliary carriages which can move transversally. The extractor device is fitted with two 'barrel' pick-up members, mobile vertically, which can be adjusted at the level of each working roll in order to engage onto the journal of the latter, whereas the working roll can thus be raised cantilever.

Such an arrangement, in which each working roll is held cantilever by a variable level supporting member, does not enable to guarantee accurate positioning of the roll and is thus hardly applicable to Z-High roll mills mentioned above, in which each working roll is clamped between two lateral carrying rollers.

Usually, in such roll mills, each working roll delineates, with the associated intermediate roll and both sets of lateral carrying rollers, an 'insert' which can be removed as a single block, whereas the assembly is supported by both chocks of the intermediate roll which can be fitted with castors running on guiding rails.

The replacement operations of the rolls are thus rather complicated and call for cumbersome devices since the whole insert must be removed, even if only the working roll must be replaced. Moreover, after removal of the insert, the replacement of the working roll is rather difficult to carry out quickly and automatically without interfering with the other sections of the insert.

Still, in modern installations, we are led to replace the working rolls quite often, for instance when changing programmes, and this operation must therefore be performed as quickly as possible. Besides, in most recent installations, running in continuous milling mode, it is interesting to have the possibility of keeping the milled band engaged in the roll stand during the replacement operations.

The invention remediates to these problems thanks to a roll changing device enabling to perform rapidly and simply the replacement operations of the working rolls when the latter are free of chocks at their ends, while reducing or suppressing the risks of interference between the different mechanic members liable to move. Such a device can operate quite reliably while remaining of relatively economic construction.

The invention is especially suited to a Z-High type mill since it enables, on the one hand, to remove both working rolls, on their own, or the insert assembly with the intermediate rolls and the associated carrying assemblies and, on the other, to remove from this assembly, the working roll without any risk of interference with the intermediate roll or the carrying rollers. Moreover, the invention also enables, if needed, to remove a single working roll or a single intermediate roll.

The invention therefore applies, generally, to a roll mill comprising, inside a fixed roll stand and on either side of a passage plane of a band to be rolled:

two working rolls with parallel axes, respectively upper and lower working rolls, delineating an air gap for the passage of the band, whereas each working roll is extended, at one end at least, by a journal, two backing-up assemblies, respectively, for each working roll, each comprising at least one intermediate roll, adjustment means of the levels in the relation to the axes of each roll with respect to the stand delineating four levels of disassembly, respectively of both working rolls and of the both intermediate rolls for which each working roll is moved away from the corresponding intermediate roll, two pairs of rails parallel to the axes of the rolls, arranged on the stand at two constant levels on which rest, respectively, each at its level of disassembly, both intermediate rolls, respectively upper and lower intermediate rolls, each via sliding carrying members for the removal of the corresponding intermediate roll.

According to the invention, the roll changing device comprises:

a handling device placed on one side of the stand and comprising at least one handling and guiding chassis on which are provided two pairs of rails aligned respectively with both pairs of rails of the stand, at least one extractor device mounted to slide at a constant level on the guiding chassis, parallel to the axes of the rolls and movable between a close position of the stand, for the disassembly and for the reassembly of the rolls, and an away removal position of the rolls inside the chassis, means to pick up each working roll comprising a carrying member mounted on the extractor device and fitted with two recesses centred respectively on two axes spaced by a constant distance equal to the distance between the disassembly levels of both working rolls, whereas the level of the carrying member is adjusted so that, in the close position of the extractor device, each recess is centred on the axis of each working roll at its disassembly level and engages in a removable way, on the journal of the corresponding working roll, by axial displacement of the extractor device, the means for adjusting the level of each working roll in order to pick-up, in a cantilever manner, the said working roll using the carrying member delineating, after engagement of the journal, a relative vertical displacement of the latter with respect to the corresponding recess, removable means for hooking each of both intermediate rolls, provided on the extractor device and actuated selectively for the control of the disassembly and of the assembly of each intermediate roll, by axial displacement, in the corresponding direction, of the extractor device, while sliding on the aligned rails.

Particularly advantageously, the carrying member comprises a single part in which are provided two cylindrical bores each constituting a recess into which engages an end portion of the journal, whereby each bore is extended, at its lower section on the roll side, by a protruding section in the shape of a semi-cylindrical cradle and on which rests, in pick-up position, the remaining section of the journal.

In the case of a Z-High roll mill where each working roll is placed inside an insert comprising two lateral carrying assemblies supported by the chocks of an intermediate roll, the extractor device can determine, selectively, using removable hooking means, the assembly and the reassembly, either of the working rolls alone, or of each whole insert, whereby each working roll is carried by the supporting member and kept at a set distance from the corresponding intermediate roll and lateral carrying assembly which slide on the guiding rails of the intermediate roll.

Generally, the roll stand is fitted with removable backing-up means, at least of the upper working roll, with two positions, respectively a position for backing up the said roll at its level of disassembly and a retracted position. In such a case, the carrying member picks up the said working roll whereas the said backing-up means are retracted after engagement of the corresponding recess on the journal of the working roll.

Besides, after opening the roll stand, the lower working roll rests on the lower intermediate roll which is connected to means for adjusting its level with respect to the roll stand. In such a case, the said level adjustment means are first set in order to place the lower working roll at its disassembly level for the engagement of the lower recess of the carrying member on the journal of the said lower working roll and to determine, by lowering the lower intermediate roll, the pick-up of the lower working roll by the carrying member.

According to a preferred embodiment, a 'side-shifter' type device is used, comprising at least two guiding chassis, installed side by side on a carriage which is movable perpendicular to the axes of the rolls. In this case, however, instead of using, as always, a single extractor device, both guiding chassis are each connected to an extractor device and can be placed in turn in replacement position, whereas one of the chassis is initially empty for the reception of the used rolls and the other chassis is fitted with at least one pair of working rolls carried by the corresponding extractor device to ensure quasi-immediate replacement of the said rolls.

Besides, the auxiliary carriage carrying both guiding chassis, each connected to an extractor device, can advantageously be mounted on a main handling carriage which is movable parallel to the axes of the rolls, between a replacement position in contact with the roll stand and a retracted maintenance position, comprising at its end turned towards the roll stand, a linking section comprising two lateral stanchions on which are mounted rail sections arranged in the alignment of the rails of the roll stand and on which the rails of each guiding chassis can be aligned, by transversal displacement of the auxiliary carriage.

According to a particularly advantageous feature, the device is connected to a mechanised storage rack connected to the roll changing device and from which new or refurbished working rolls as well as used working rolls can be loaded or unloaded automatically.

Advantageously, the storage rack comprises at least one rest bar on which are provided at least two locations for depositing the working rolls each fitted with a pair of spaced cradles, centred on an axis parallel to the axes of the rolls of the mill, for depositing, on the said rest bar, a working roll fitted, at both its ends, with two journals resting on the said spaced cradles, whereas one of the said locations is free to accommodate a used working roll and the other one of the said locations is occupied by a substitute roll.

The invention relates also to other advantageous features subject mater of the subclaims and which will be described more in detail while referring to an embodiment illustrated on the appended drawings, which are not limitative in way.

Figure 1:
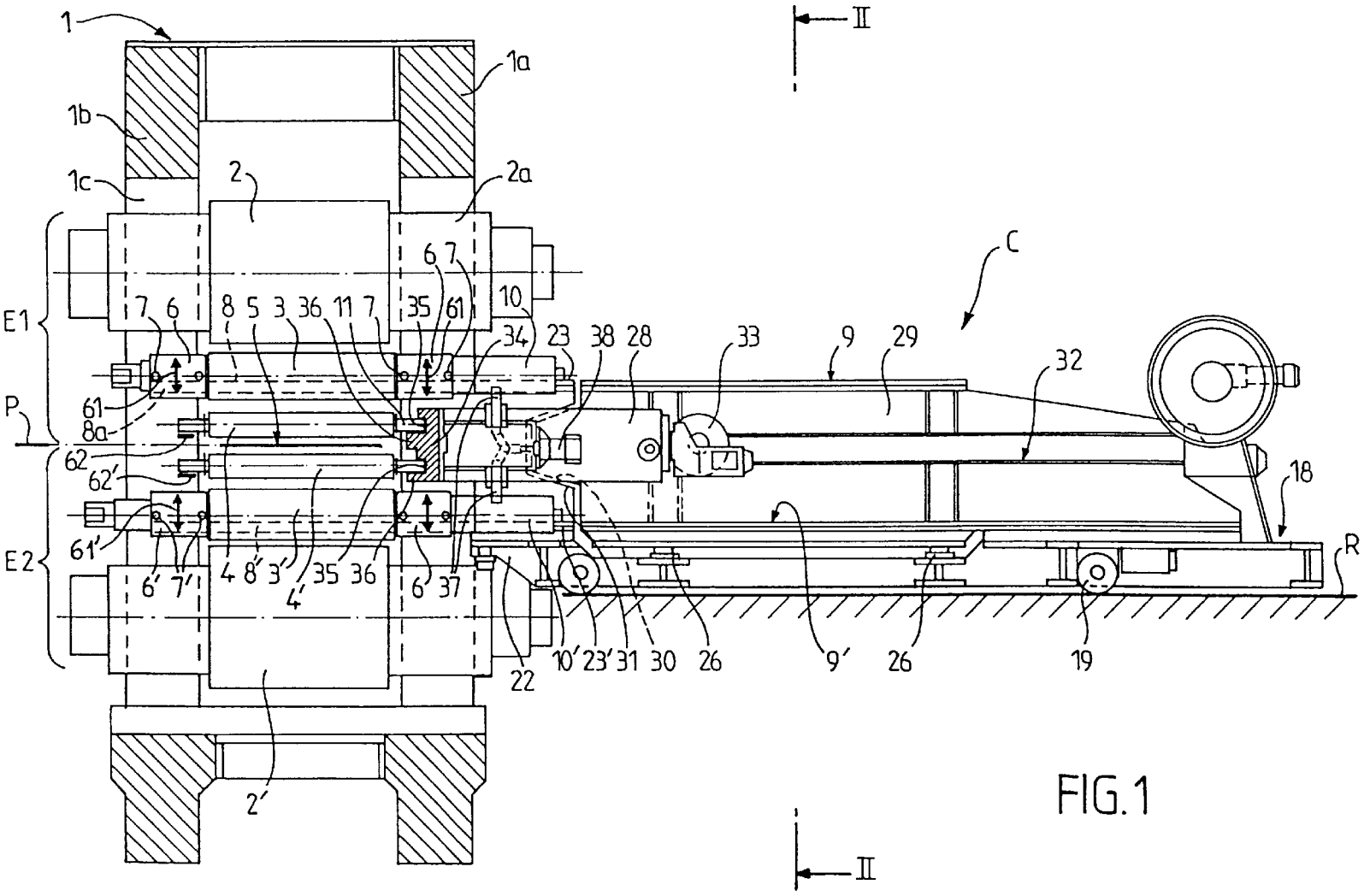
FIG. 1 is a schematic sectional vertical view along the line I—I of FIG. 2 of a sexto-type roll stand with lateral rests and of the roll changing device according to the invention.

FIGS. 1 to 4 show schematically a roll stand 1 of sexto or Z-High type comprising two sets of rolls E1, E2, respectively upper and lower rolls, symmetrical with respect to the mean roll plane P or pass line. Each assembly comprises a backing-up roll 2, an intermediate roll 3 and a working roll 4 of decreasing diameters, whereas these rolls have their axes parallel and placed substantially in a clamping plane P' perpendicular to the roll plane P.

The backing-up rolls 2 and the intermediate rolls 3 are rotably mounted around their axis and are guided vertically in the stanchions 1*a*, 1*b* of the roll stand 1, in order to be able to move vertically under the effect of clamping means 17 (FIG. 4) described thereunder. In the position represented on FIG. 1, the roll stand is in open position, whereas the rolls are slightly spaced from one another in order to enable assembly and disassembly. In working configuration, the backing-up rolls 2, 2' are in contact with the intermediate rolls 3, 3' which are, for their own parts, in contact with the working rolls 4, 4' between which the band to be rolled 5 is clamped under the action of screws or jacks 17.

Besides, motorised means, not represented, placed on a 'driving' side of the roll stand 1, i.e. on the left on FIG. 1, enable to drive into rotation the intermediate rolls 3 which drive, in turn, the working rolls 4 to determine the forward motion of the band 5 clamped between the said rolls.

On the 'operator' side, on the right of the roll stand 1, according to FIG. 1, is placed a device C for changing the working rolls 4 and the intermediate rolls 3.

The backing-up rolls 2, 2' and the intermediate rolls 3, 3' are fitted, at each end, with a chock composed, usually, of a case in which is mounted a bearing for centring a journal provided at the corresponding axial end of the roll.

Conventionally, each chock is inserted in a window provided on the corresponding stanchion 1*a*, 1*b* of the roll stand 1 and can slide vertically along the guiding faces provided on the sides of the window or, for the chocks 6 of the intermediate rolls 3, 3', on massive parts fixed on the roll stand and forming hydraulic blocks B carrying hydraulic jacks 61, 61' (symbolised on the figure as arrows), which enable to set apart or to bring closer the chocks in order to determine a curvature, respectively positive or negative of the intermediate rolls and, consequently, of the working rolls.

Figure 4:
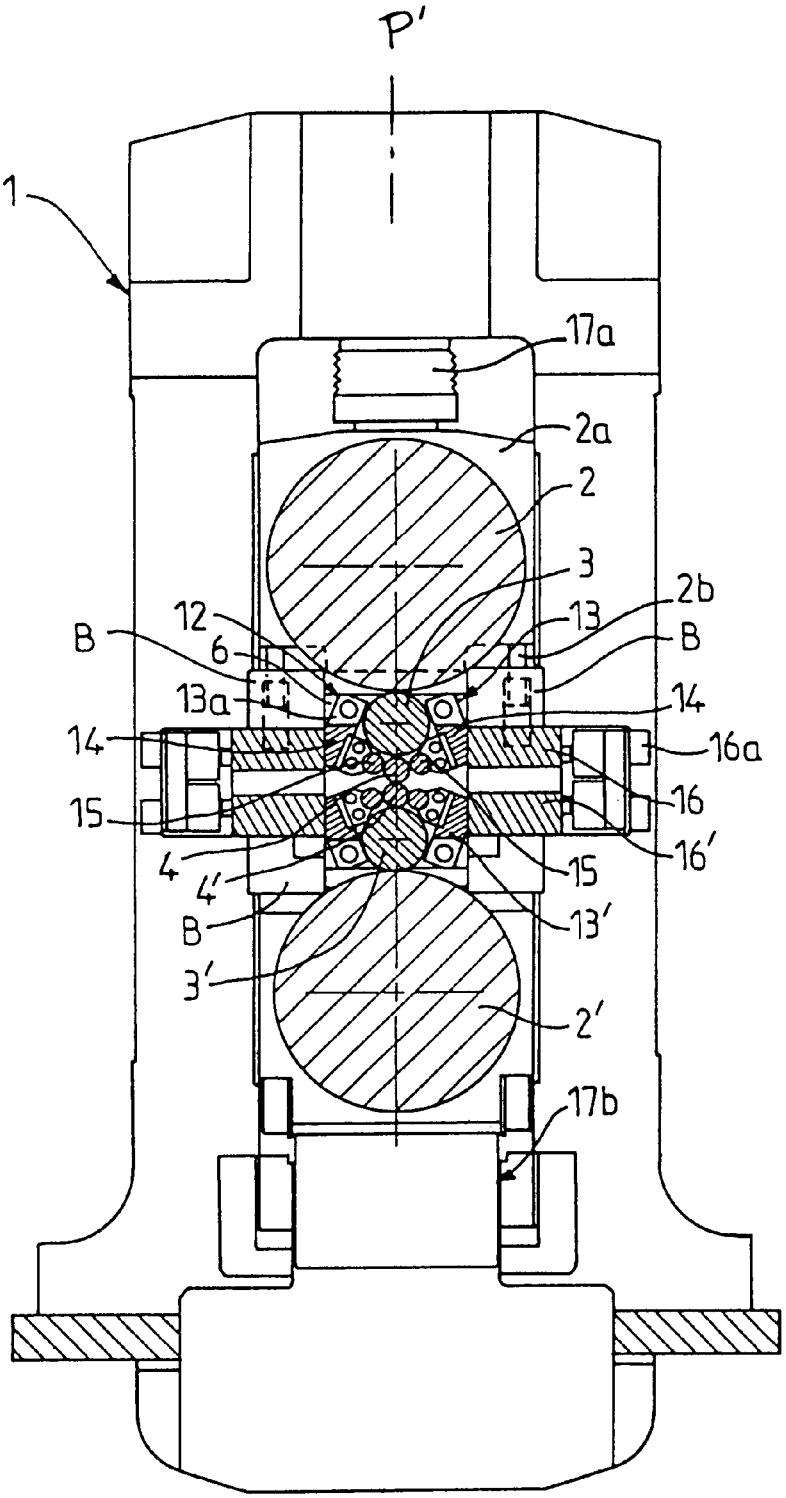
FIG. 4 is a vertical section, perpendicular to the axes of the rolls, at larger scale, of a sexto-type roll stand with lateral rests.

In the example represented on FIG. 4, both stanchions of the roll stand 1 are fitted with clamping means such as the screws 17*a* resting on the chocks 2*a* of the upper backing-up roll 2, chocks resting in turn on balancing jacks 2*b* which are mounted on the hydraulic blocks B. On the other side of the band, the chocks of the lower backing-up roll 2' rest on hydraulic jacks 17*b* forming adjustable shims.

Thus, during a roll pass, the clamping screws 17*a* determine the general level of the pass line whereas the hydraulic jacks 17*b* enable to adjust the clamping load and the width of the air gap between the working rolls 4.

To enable disassembly of the intermediate rolls 3, 3', their chocks 6, 6' are fitted externally with rolling castors 7, 7' which, by vertical displacement of the roll, come to rest on rails 8, 8' provided on the hydraulic blocks of the roll stand 1 and extended by rails 9, 9' provided on the handling device C. Each chock 6, 6' located on the operator side is fitted with a hooking member 10 enabling handling operations.

The level of the intermediate rolls can be adjusted by the curving jacks 61. However, the level of the lower intermediate roll 3' which rests on the backing-up roll 2' can also be determined by the lower shims 17*b* when the latter are adjustable.

In a well-known fashion, to enable vertical displacements of the rolls, the sections 8*a* of the rails 8, 8' corresponding to both stanchions of the roll stand 1 can be retracted in order not to protrude over the guiding faces during the milling process. These retractable sections are returned to their original positions only after opening of the rolls to allow for the retraction of the latter.

If needed, the roll stand 1 can also be fitted with rails not represented, enabling disassembly of the backing-up, respectively upper 2 and lower 2' rolls.

As indicated, the working rolls 4, 4' whose diameter is reduced, do not have any chocks and are fitted, at each axial end, with extensions in the form of cylindrical journals 11 which rest, in disassembly position, on removable supporting means 62, 62' indicated schematically on FIG. 1.

The invention relates especially to a Z-High type mill in which each intermediate roll 3 is connected, as shown on FIG. 4, to two lateral carrying assemblies 13 placed on either side of the working roll 4 and extending over its whole length.

Each lateral carrying assembly 13 comprises at least three rollers with axes parallel to those of the rolls, respectively one roller 15 extending along the working roll and resting in turn on two other rollers. The set of rollers is mounted on a girder 14 carried, at both its ends, by articulated arms respectively on both chocks 6 of the intermediate roll 3. The said chocks are mounted to slide, in a well-known fashion, between vertical guiding faces provided on two hydraulic blocks B fixed on the stanchions of the roll stand 1 and carrying the hydraulic curving jacks 61, 61'. The latter rest on lateral ears (not represented) of the chock 6 and can also perform height adjustment of the intermediate rolls, particularly for the opening of the roll stand.

In the preferred embodiment represented, for exemplification purposes, on FIG. 4, both lateral carrying assemblies 13 of each working roll 4, 4' are connected respectively, to two horizontal beams 16 arranged symmetrically on either side of the clamping plane P' and displaceable horizontally in order to adjust their lateral position with respect to the working roll. Each beam 16 extends, between both stanchions 1*a*, 1*b*, along the girder 14 supporting the corresponding lateral rollers 15 and thus delineates, for the lateral carrying assembly 13, a reference face whose position can be adjusted by horizontal sliding of the beam 16, for instance under the action of screw/bolt adjustment devices 16*a* installed on the roll stand 1 and each controlled by a stand-alone motor. However, no horizontal clamping load of the working roll 4 is applied between both carrying assemblies 13 not to disturb the vertical displacements of the intermediate roll 3 with its chocks 6, for instance under the action of the curving jacks. A small clearance is thus left between the girders 14 and the corresponding faces of the beams 16 which may slide one onto the other while simply providing the lateral holding of the working roll 4, particularly to enable it to resist horizontal flexion loads during the passage of the product.

The lateral carrying assemblies 13, 13' of each working roll 4, 4' are supported by the chocks 6, 6' of the corresponding intermediate roll 3, 3'. Moreover, each working roll 4, 4' can rest, via its journals 11 on removable brackets 62, 62' which have only been represented schematically on FIG. 1 and which are constituted of retractable forks mounted, for instance, on the hydraulic blocks and which move until they reach under the journals 11 of the working roll in order to carry the said roll, whereby the said forks can be withdrawn laterally in order to free the working roll when the latter engages the product.

In order to proceed to any replacement, the milling process is stopped but it is possible, advantageously, to let the band engaged between the working rolls which are simply spaced apart, upwards and downwards, at sufficient distance from the band to enable handling operations.

To this end, using hydraulic jacks 17*b*, the lower backing-up roll 2 is lowered, whereas its chocks rest, in down position, on stops or, via castors, on rails which have not been represented, enabling the retraction of the lower roll 2.

Besides, the balancing jacks 2*b*, which rest on the hydraulic blocks B, raise the upper backing-up roll 2 to upper position, whereas the screws 17*a* are raised.

Both inserts, respectively lower and upper inserts, are then held by curving jacks 61, 61'.

The working rolls 4, 4' then rest on the forks 62, 62' and the level of the latter is determined in order to leave, between each working roll 4, 4' and the corresponding intermediate roll 3, 3' a slight clearance enabling axial displacements without any risk of contact among the rolls.

After opening the rolls, the removable sections 8*a* of the running rails 8 are placed and both inserts are lowered using the curving jacks 61, 61', whereby the chocks 6, 6' of the intermediate rolls 3, 3' rest, with their castors 7, 7' on the rail sections 8*a* which are placed in the alignment of the fixed rails 8, 8' whose level is adjusted in order to leave an interval between the generating lines opposite each intermediate roll 3, 3' and opposite the corresponding backing-up roll 2, 2'. Since, as indicated previously, each working roll 4, 4' is held slightly apart from the intermediate roll 3, 3' by the supporting forks carried by the chocks of the intermediate roll, all the rolls are spaced apart from each other and can be moved freely.

The roll changing device C comprises a main handling carriage 18, mobile in translation, along a direction parallel to the axes of the rolls 3 and 4, in relation to the roll stand 1. The carriage 18 runs, using wheels 19, on rails R (FIG. 2) fixed to the ground. For instance as shown schematically-on FIG. 7, the carriage 18 is designed for moving along the working zone situated in the vicinity of the roll stand 1 up to a maintenance position away from the roll stand 1 and located in a hall 20 intended for grinding or refurbishing the working and intermediate rolls, situated on the side of the main building 21 where the mill 1 can be found. The median plane of the handling carriage 18 is centred on the clamping plane P' of the roll stand.

In order to reduce the handling operations and to accelerate the operations, in the preferred embodiment represented on FIG. 1, the main carriage 18 is associated with a lateral carriage 25 mobile in translation on the carriage 18 along a direction parallel to the forward direction in the mill 1, i.e. perpendicular to the axes of the rolls. For instance, the carriage 25 can be supported by wheels 26 (FIG. 2) running on rails 27 fixed on the main carriage 18 and parallel to the forward direction in the mill.

On the lateral carriage 25 can be arranged at least two chassis 29 each fitted with a roll extractor device 28, mobile in translation on the chassis 29, along a direction parallel to the axes of the rolls 3 and 4. Both extractor devices 28 move therefore together with the lateral carriage 25, perpendicular to the axes of the rolls, to reach a position, in turn, aligned with the stand.

Figure 2:
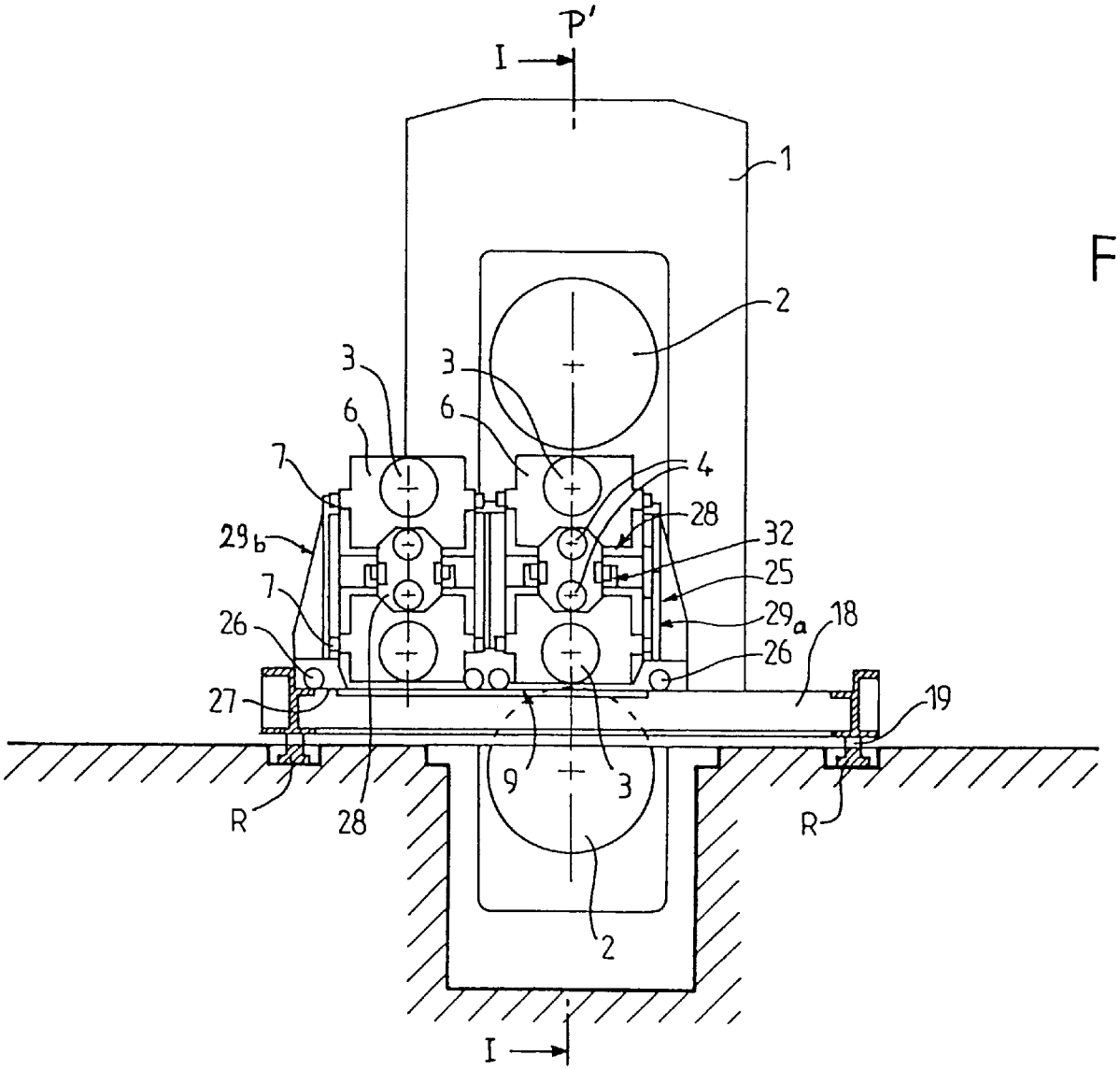
FIG. 2 is a sectional view along the line II—II of FIG. 1 with a roll changing device comprising two extractors mounted on a lateral carriage.
Figure 3:
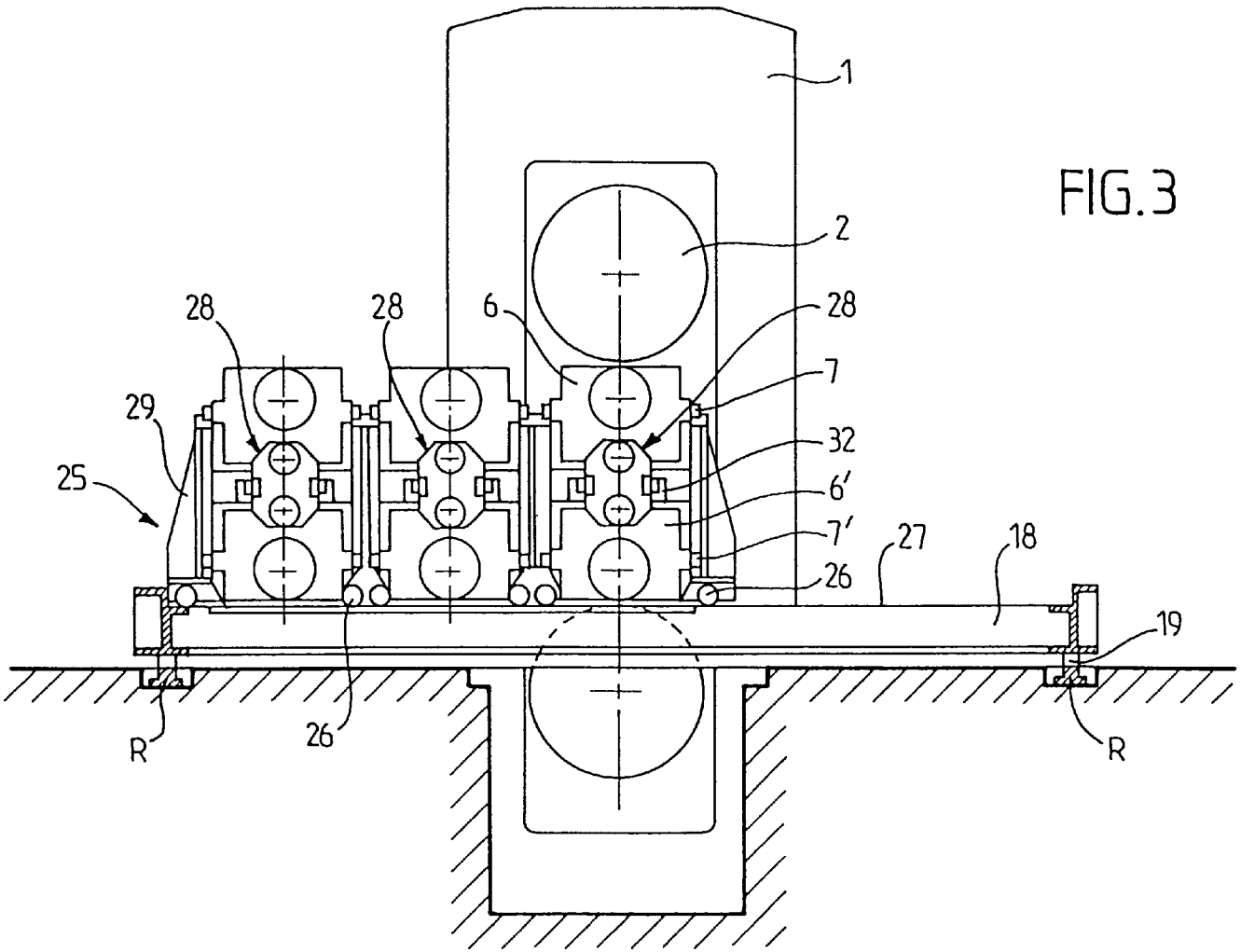
FIG. 3 is a view similar to FIG. 2 of an embodiment in which three extracting devices are mounted on a lateral carriage.

FIGS. 2 and 3 show respectively, as a cross section, installations with two or three extractor devices.

Each chassis 29 connected to an extractor device 28 is delineated by two vertical carrying walls which are fitted, at their upper and lower levels, with two pairs of rails 9, 9' coming respectively in the alignment of the pairs of fixed rails 8 and 8' when vertical median plane of the extractor device 28 affected overlaps the clamping plane P' of the roll stand 1.

To ensure continuity between the stand 1 and each chassis 29, the carriage is fitted, at its end turned towards the stand 1, with a linking section 22. The latter exhibits, in transversal section, a U-shape comprising two lateral stanchions 22, spread from one another, which in the close position of the carriage 18, surround the hooking means 10 of the chocks 6. On both stanchions 22 are fixed rail sections 23, 23' placed at the level of the rails 8, 8' of the stand 1 and rails 9,9' of the carriage 25 and spaced by the same distance.

Thus, when the handling carriage 18 is in its position close to the stand 1, each chassis 29 can be centred, by displacement of the carriage 25, on the median plane P' of the stand, whereby both pairs of rails 9, 9' are linked to both pairs of fixed rails 8, 8' by the sections 23, 23' to build two continuous raceways. Each chassis 29 constitutes therefore a reception or storage box for the rolls.

Advantageously, the vertical walls 29 delineating each reception box can comprise, at their end turned to the stand 1, each a protrusion 30 in the shape of a trapezoidal nose, arranged substantially at mid-height, in order to engage into a scalloping 31 of matching shape provided in the corresponding lateral wall of the end 22 of the carriage 18.

Each extractor device 28 is guided on the auxiliary carriage 25, by two guiding rails 32, which are fixed substantially at mid-height of the carrying walls 29 and can be extended on the protruding section 30, beyond the rails 9, 9' in order to penetrate, at the level of the rails 23, 23', between the hooking members 10, 10' of the intermediate rolls 3, 3', in the close position of the handling carriage 18.

Figure 5:
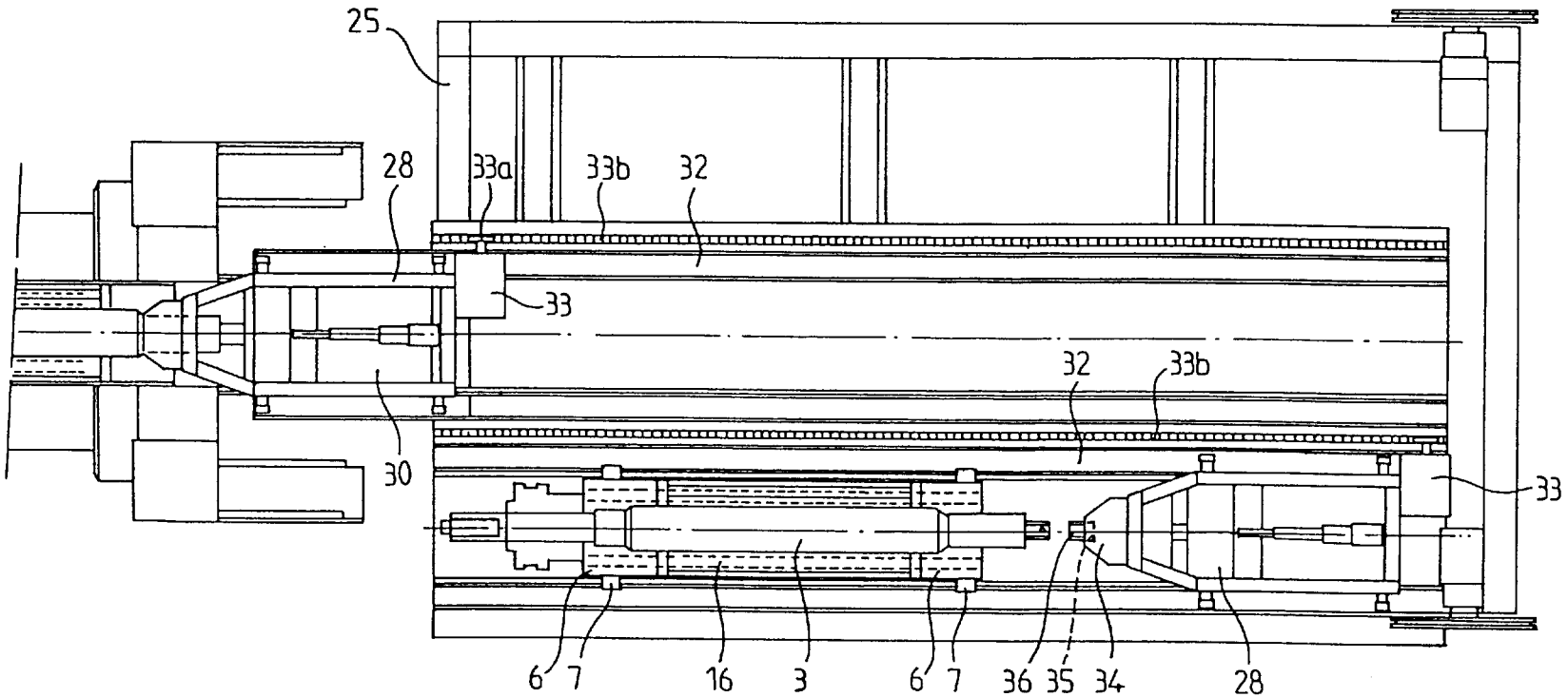
FIG. 5 is a top view of a device with lateral carriage fitted with two extracting devices.

The displacement on the rails 32 of the extractor device 28 is controlled by a pinion-rack system driven by an electric geared motor 33 installed on the extractor device 28 and which control the rotation of a pinion 33*a* engaging into a rack 33*b* fixed on the carriage 25, along the rails 32 (FIG. 5).

Since the working rolls are free of chocks and simply fitted, at their ends, with protruding journals, the extractor device is fitted with a supporting member 34 arranged in order to grip each working roll using the journal placed on the operator's side, while holding the working roll cantilever in a recess 35 of the supporting member. Moreover, to perform simultaneously the replacement of both working rolls, while holding them apart from one another, each at a determined level, the supporting member 34 is fixed at a constant level on the extractor device 28 and is constituted of a massive part comprising two recesses in the form of dummy bores 35 with parallel axes, spaced vertically by a distance equal to that between the geometrical axes of the rolls 4, 4' when the later rest, in replacement position, on the supporting forks 62, 62'. The diameter of the dummy bores 35 is substantially equal to the diameter of the journals 11, with a single clearance enabling to readily engage the journals 11 into the bores 35 by a translation movement of the extractor 28 along the direction of the geometrical axes of the rolls 4, 4'.

Thanks to this arrangement, all the displacements of the extractor device 28 are performed while taking as a guiding reference the rails 9 of the chassis 29 aligned with the rails 8 of the roll stand 1. The result is excellent accuracy and high speed of the replacement operations of the working rolls.

Generally, indeed, the relative levels of the rolls are variable since they depend on their degree of wear. However, in the position according to the invention, the working rolls are always picked up at a preset level in relation to the reference levels of the fixed guiding rails 8, 8', whereby both recesses 35 are placed on a single part mounted to slide at a constant level delineated by the rails 32 of the chassis 29.

In practice, for each roll stand, and whatever the degree of wear of the rolls, the replacement levels of the intermediate rolls are defined by the rails 8, 8' and the replacement levels of the working rolls are determined by the positions of the supporting members 62, 62', whereby the axes of the working rolls are separated, in this position, by a constant distance. It therefore suffices to foresee, if needed, adjustment in height of the massive part 34 with respect to the extraction carriage 28 to align, with accuracy, the axes of the recesses 35 on the axes of the working rolls. This adjustment can be performed in advance on all the extractor device 28 connected to the stand 1, so that, after installation of an extractor device in the median plane of the stand, the recesses 35 engage directly into the journals 11 of the working rolls 4, 4' placed in disassembly position.

It is preferable, however, to limit the engagement depth of each recess 35 in order to avoid any risk of misalignment.

Therefore, in the preferred arrangement represented on the figures, the depth of each bore 35 is smaller than the length of the journal 11 only the extreme section of which engages into the recess thus constituted and the latter is extended, at its lower section, by a section substantially cylindrical forming a cradle 36 and protruding towards the rolls 4, 4'.

The ends of the journals 11 into the recesses 35, 35' thus engage over rather small a distance in order to avoid any friction and risks of misalignment. At that moment, it suffices to move the forks 62, 62' away which carry the working rolls 4, 4' so that the latter rest on the lower protruding sections forming a cradle 36 and can be held cantilever by the journals 11 resting on the carrying member 34 in two zones spaced from one another, respectively upwards on the external side and downwards on the internal side.

The relative lowering effect thus provided is simply equal to the clearance left between the recesses 35 and the journals 11 to enable easy engagement of the latter. The engagement length, equal to the depth of the recess 35, must simply be sufficient to enable cantilever holding of the roll without any risk of upsetting the resting sections.

Other dispositions could also be contemplated so that a double carrying member, of constant level picks up the rolls.

For instance, the carrying member 34 could be fitted for each working roll with a clamping member comprising two pairs of jaws, respectively lower and upper jaws, maintained in open position to engage on the journal 11 of each working roll 4, 4' by axial displacement of the extractor device 28, whereas each pair of jaws would be centred on an axis placed in the alignment of the axis of the working roll, at the disassembly level of the latter.

After engagement of the journal, both jaws are clamped on the former and the roll 4 is thus held cantilever by its end journal 11.

In all cases, the very accurate guiding of the extractor device 28 on its rails 32 enables the retraction of both working rolls 4, 4' without any risks of damage, whereas each roll is carried by a support whose level remains constant and which moves parallel to its axis.

Besides, each extractor device 28 is fitted so that it may withdraw, if needed, either both working rolls 4, 4' or both inserts each comprising an intermediate roll with the associated working roll and its two lateral carrying assemblies.

Indeed, as stated above, the lateral carriage 25 on which is mounted the extractor device 28 is laid out so that the latter can penetrate into the space delineated between the chocks 6, 6' of the intermediate rolls 3, 3', in a position for which the rails 8, 8' of the roll stand 1 are aligned with the rails 23, 23' of the handling carriage 18 and the rails 9, 9' of the lateral carriage 29.

The extractor device 28 which moves over the rails 32 is fitted with removable pick-up members which, if needed, may engage onto the hooking means 10, 10' of the chocks 6, 6' of the intermediate rolls 3, 3' in order to remove the assembly composed of each insert with the corresponding working roll.

For instance, in the preferred embodiment represented on FIG. 1, the extractor device 28 is fitted, in its upper section and in its lower section with vertical hooking fingers 37, oriented in opposite directions. These fingers 37 are mobile vertically and controlled, for instance, by an electric or hydraulic jack 38, of horizontal axis, linked to the fingers 37 by a set of rods intended for controlling their vertical displacement. To this end, a cam-operated control system could also be employed.

When the extractor device 28 is in loading position, corresponding to the engagement of the journals 11 into the bores 35, the extension of the fingers 37 which engage into corresponding orifices provided on the hooking members 10 of the intermediate rolls 3, is actuated.

As stated previously, the chocks 6, 6' of each intermediate roll carry the lateral carrying assemblies associated with the corresponding working rolls. While hooking the members 10 by the fingers 37, we can thus withdraw the insert assembly which is driven by the extractor 28 into a translation to the right according to the representation on FIG. 1.

The working roll 4 is supported by the carrying member 34 whereas the intermediate roll 3 as well as the lateral carrying assemblies are supported by the chocks 6 which, using castors 7, run in succession on the rails 8, 23, 9 until the insert assembly is placed on the lateral carriage 25.

However, since the recesses 35 are held at constant level with respect to that of the rails 8, 8', 9, 9', thanks to the sliding motion of the carrying member 34, the translation operations can be performed in all safety, with any risks of interference between the rolls.

It is thus possible to withdraw the rolls from the stand and to transport them, using the handling carriage 18, to the maintenance zone where they are replaced with new rolls. The latter are then inserted into the roll stand by displacement of the handling carriage 18 and of the extractor device 28 in opposite directions. All the displacements are perfectly guided with respect to the reference level defined by the rails 8, 9, 8', 9'.

As stated, the replacement can be almost immediate if the handling carriage 18 is fitted with a lateral carriage 25 providing at least two reception boxes 29 each fitted with an extractor device.

To this end, as shown on FIG. 5, one of the boxes 29*a* is empty and can be placed in advance in the alignment of the stand. After withdrawal of the worn rolls into the empty box 29*a*, the carriage 25 moves laterally in order to centre in the median plane P' of the stand, the neighbouring box 29*b* in which have been placed in advance the replacement rolls which can then be inserted immediately into the stand 1.

It should be noted that the device according to the invention also advantageously enables selective replacement either of the working rolls alone or of the assembly composed of each insert, respectively upper or lower insert.

When the lateral carriage 25 comprises two reception boxes 29 each associated with an extractor device 28, as illustrated on FIG. 2, the first box 29*a* is completely empty in order to withdraw, according to the requirements, either the working rolls 4, 4' alone or the assembly composed of each insert comprising an intermediate roll 3, the lateral carrying assemblies and the working roll. Exceptionally, even a single working roll can be withdrawn. Indeed, after engagement of the recesses 35, 35' on the journals of both working rolls 4, 4', the withdrawal of the carrying forks can be controlled solely for a single one of both working rolls, for example the upper roll 4 which, in this case, rests alone of the cradle 36 associated with the recess 35. The other roll, for instance, the lower roll 4' is still supported by its carrying forks 62' and remains thus inside the stand 1 when the extractor device 28 is pulled aside.

Conversely, the fingers 37 can be controlled selectively in order to determine the withdrawal, with the extractor device 28, of either intermediate roll associated with the lateral carrying assemblies.

The rolls to be replaced are thus placed into the reception box 29*a*, which is initially empty, of the carriage 25.

If we have withdrawn from the stand a single working roll, the handling carriage 18 then brings the extractor device into maintenance position in view of the replacement of the roll.

However, this situation is rather rare and, generally, both working rolls are replaced at the same time.

Therefore, if the 'side-shifter' type device, represented on the figures, is used, the second box 29*b* of the carriage 25 is fitted in advance with two complete inserts, respectively upper and lower inserts, each comprising a working roll, an intermediate roll and its lateral carrying assemblies. Still, since each reception box is fitted with an extractor device, the working rolls and the intermediate rolls are supported separately, respectively by the carrying member 34 and by the rails 9, 9' of the chassis 29*b*.

By transversal displacement of the auxiliary carriage 25, the second reception box 29*b* is then centred in the median plane P' of the stand. Once solely the working rolls 4, 4' have been withdrawn from the said stand, the hooking fingers 37 are cleared away so that the intermediate rolls and the lateral carrying assemblies remain in position in the chassis 29*b*, whereas the extractor device 28 solely inserting into the stand both working rolls 4, 4'. The forks 62, 62' are then placed in position while raising slightly the working rolls which then relieve the carrying members 34 and the extractor device 28 can then be withdrawn.

On the other hand, if the complete inserts have been removed, it suffices to actuate the hooking fingers 37 or solely one of them to place into the stand either both inserts or a single insert in replacement of the one removed.

In an improved embodiment illustrated on FIG. 3, the lateral carriage 25 is fitted with three extractor devices 28; in such a case, two extractor devices are loaded with new rolls, the other one remaining empty in order to extract a first set of worn rolls from the stand. It is then possible to perform two successive changes of rolls without bringing the whole main carriage and the lateral carriage 25 to the grinding workshop 20.

After the first change, the box thus relieved of the carriage 25 remains aligned with the stand and may be used for the withdrawal of the rolls. A simple displacement of the carriage 25 enables then to centre the third box in front of the stand 1 to perform a second change.

It is then possible to change milling programmes very quickly while leaving the band engaged in the line.

Obviously, the device is only represented schematically on the figures but it comprises all the auxiliary members necessary to the operation of the carriages 18, 25 and of the extractor device 28, especially for the winding and the unwinding of the electric cables and/or hydraulic ducts connected to the different mobile members.

On the other hand, the displacements of the carriages can be controlled in various ways. For instance, to ensure the translation displacement of the extractor carriages 28, the geared assembly 33 moving along a rack 33*b* could be replaced with a pusher chain actuated by a motor mounted directly on the carriage 25.

Figure 7:
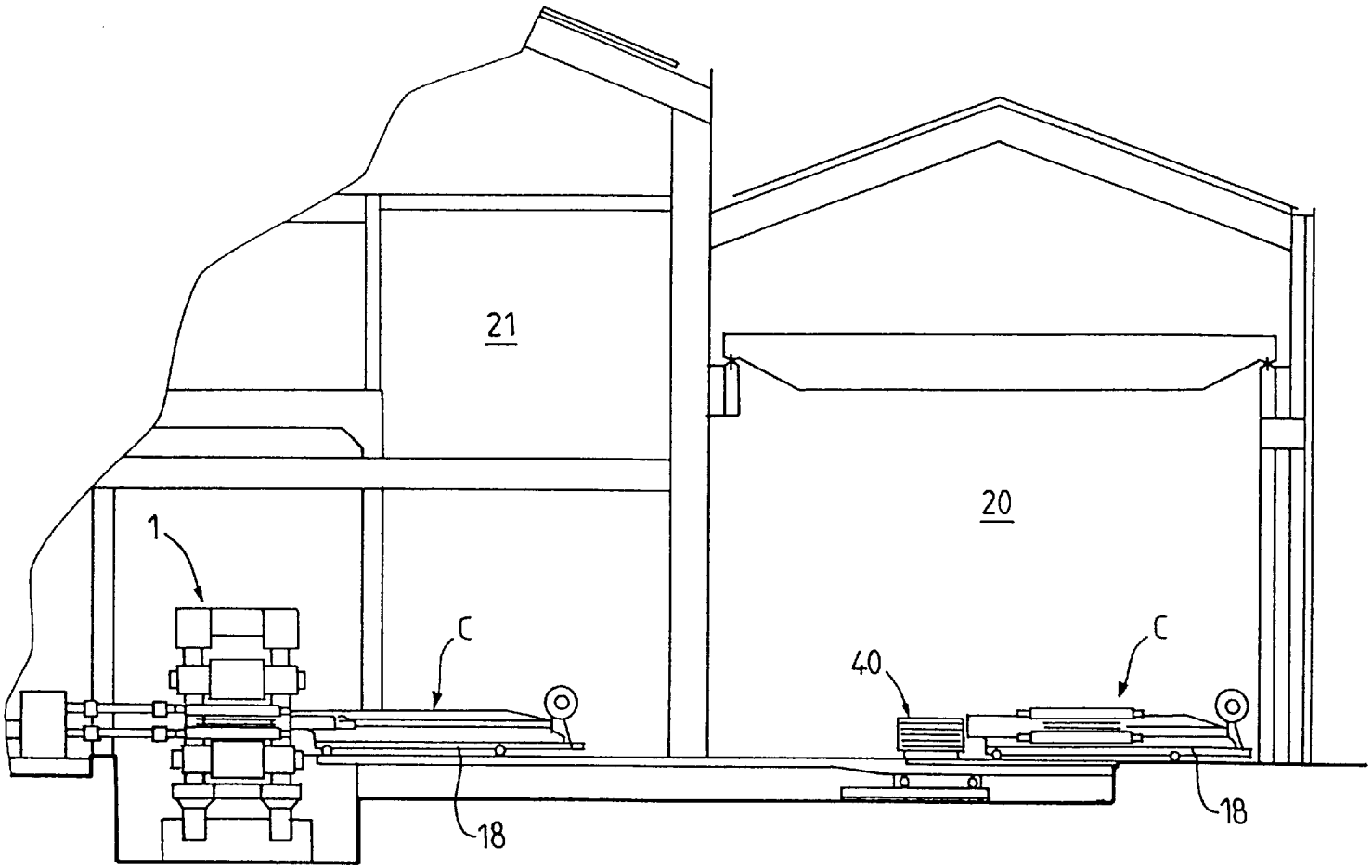
FIG. 7 represents schematically, as a transversal section, a mill workshop assembly fitted with a roll changing device according to the invention.

As shown on FIG. 7, the loading/unloading of the new/worn rolls on the extractor devices 28 of the lateral carriage is performed in a grinding workshop 20 placed beside the hall 21 of the mill.

Since even in case of removal of the complete inserts, the working rolls 4, 4' are held cantilever by the carrying member 34, it is particularly advantageous to use, for replacement purposes, one or several mechanised storage racks 40 which can be placed in front of the handling carriage 18 when the latter is in its most retracted position inside the grinding workshop 20.

Figure 6:
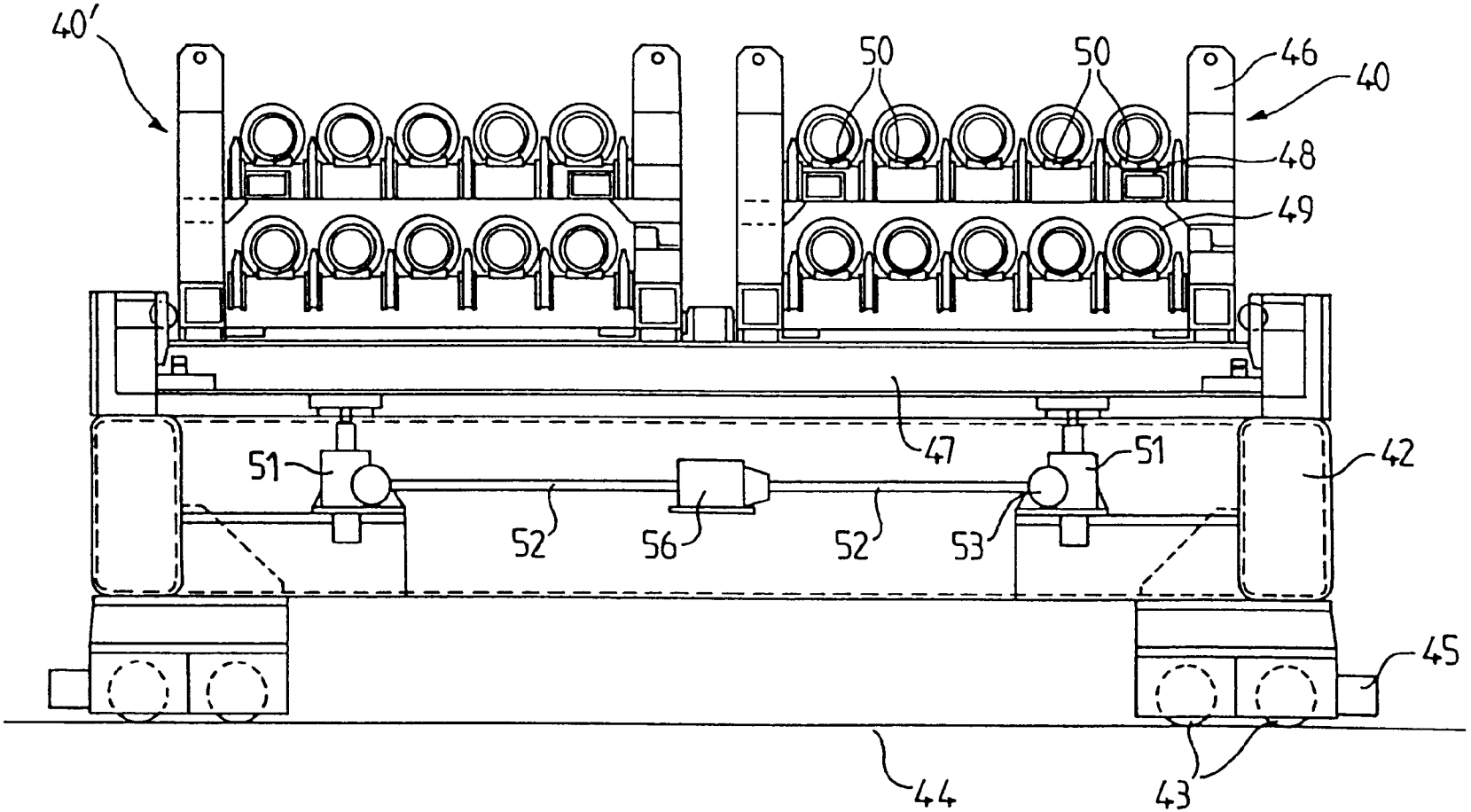
FIG. 6 is an elevation view of a mechanised rack for working rolls.

FIG. 6 is a cross sectional view of such a device which is mounted on a lower structure 42 supported by wheels 43 running on rails 44 parallel to the forward direction of the band to be rolled, i.e. perpendicular to the axes of the rolls in place in the stand 1.

In the example represented on FIG. 6, the device comprises two racks 40, 40' arranged side by side on a frame 47 resting on the structure 42 via four supports 51 of variable height, which can be made of, for instance, screws/jacks actuated synchronously through tie bars 52 and angular transmissions 53, by a geared assembly 56 enabling vertical ascending and descending motion of the frame 47 carrying the storage racks 40, 40'.

Each rack is constituted of a U-shaped chassis 46 supporting two superimposed rest bars, respectively upper 48 and lower 49 rest bars, each fitted with a series of cradles 50 parallel and delineating two levels of reception.

The upper level cradles 48 are at right angle with respect to those of lower level 49 and the vertical distance between two levels of reception is equal to the vertical distance between the axes of the dummy bores 35 of the carrying member 34.

In the example considered, each level comprises five cradles 50, each storage rack 40 can thus accommodate five pairs of working rolls 4.

The rest bars 46 are open on the right side on the figure so that, by a longitudinal translation motion to the left of the extractor device 28, both working rolls 4, 4' supported by the carrying member 34 can be placed above both superimposed cradles 50 which have been left free on both rest bars 48 and 49.

Using the carrying members 51, the frame 47 can then be raised so that both rest bars 48, 49 can pick up both working rolls 4, 4' which come slightly away from the protruding sections 36 of the carrying member 34 and are thus laid on both free spaces of the storage rack 40.

Once the carrying member 34 has been unloaded, the extractor device 28 can be brought backward in order to release the journals of the worn rolls, then transversal displacement of the storage rack 40 can be centred in order to control, in relation to the programme to be performed, a pair of new rolls on the median plane of the extractor device. The latter is then brought forward so that the recesses 35 of the carrying member 34 engage onto the journals of both replacement rolls.

After engagement the frame 47 is lowered using screws 51 and both replacement rolls are thus held cantilever by the carrying member 34 in a box of the carriage 25, whereas the other box is empty.

The storage rack 40 can then be spread apart to enable the axial displacement of the handling carriage 18 which moves to a stand-by position beside the stand 1, whereas the free box of the carriage 25 is centred on the tightening plane P'. The device is thus ready to proceed to the removal of the operating rolls and to replace them with the new rolls taken from the storage rack 40 at the time specified by the rolling programme.

It should be noted that thanks to the independent support of the working rolls 4, 4', the latter could be removed from the insert and placed onto the storage rack 40 without any risks of contact with the other rolls.

It is then possible to proceed to the checking and the maintenance of the rest of the insert comprising the intermediate roll, its chocks and both lateral carrying assemblies, without any risks of damage of the working roll. In case of need, the insert assembly can be removed and replaced using a rolling bridge, whereby slings can be hooked easily on the chocks of each intermediate roll.

As can be seen on FIG. 7, when removing or picking up the rolls, the main carriage 18 is on the side of the storage rack 40 opposite the stand 1.

In the case of a tandem mill, each roll stand would be fitted with a main carriage 18 with lateral carriage 25 and extractor device 28, whereby each storage rack 40 of the working rolls 4 could feed several stands.

Thanks to the arrangements which have just been described, the rolls of a mill, in particular the 'Z-High' type, can be changed very quickly and without any risk of damage of the rolls, since the laminated band could remain inserted quite far and is liable to follow running.

When the working rolls or possibly the complete inserts must be removed for verification and replacement, the stand is open as stated above, whereas all the rolls are released from one another.

The handling carriage 18 is then brought closer to the stand 1, in the position illustrated by the FIG. 1, whereas the extractor device 28 is brought backward to the right on the figure.

One of the boxes of the carriage 25 is empty and is centred on the median plane P' of the stand by lateral displacement of the carriage 25.

The extractor device 28 is then brought forward and enables, as stated, to remove either both working rolls on their own, or both inserts and, by retraction of the extractor device 28, the rolls are placed on the carriage 25. The latter is then moved in order to centre the replacement rolls which are inserted into the stand while controlling the reverse operations.

After closing the stand, the rolling process may be made again and during this time, the handling carriage 18 is brought back to the grinding workshop 20.

Once the whole insert has been removed, the extractor device 28 is disconnected from the chocks of the intermediate rolls and can be brought forward to place the working rolls alone on two empty cradles of the storage rack 40 previously centred on the median plane of the extractor device 28, the remnant of the insert resting in the box 29 of the lateral carriage 25. Consequently, the inserts can be checked and, possibly, replaced, without any risks of damaging the working rolls.

The extractor device 28 comes back onto the carriage 25 and, after unloading, is retracted in order to release the storage rack 40.

The latter is then displaced in order to centre the new working rolls on the median plane of the extractor device 28 and then brought forward to pick up the new rolls.

Once the storage rack 40 has moved away, the handling carriage 18 can advance again to the stand, ready for a new replacement operation.

Obviously, the invention is not limited to the details of the preferred embodiment which has just been described and which could be modified without departing from the scope defined by the claims.

In particular, in the embodiment which has just been described and which relates to a Z-High type mill, the working rolls are supported, in removal position, by forks 62, 62', but other carrying device could be used to maintain the working rolls spread apart, at constant level, from the intermediate rolls. For instance, in a stand comprising jacks for curving the working rolls, these jacks could be used to adjust the level of the axes of the working rolls at the level of the axes of the recesses 35 of the carrying member 34 and, then, determine the lowering motion of either working roll to enable the latter to be picked up by the carrying member 34.

Besides, since when opening the stand, the lower working roll 4' rests on the lower intermediate roll 3', the level adjustment means of the latter can be used to control the picking-up of the lower working roll 4. In particular, when the lower carrying assembly E2 rests on adjustable shims 17*b*, the latter can be used in order to place the axis of the lower working roll 4' at the level of the axis of the recess 35' of the carrying member 34, whereas the level of the upper working roll 4 is determined, as previously by the forks 62.

The extractor device 28 is then brought forward so that both recesses 35, 35' engage onto the journals of both working rolls 4, 4' and, using the shims 17*b*, we determine the lowering motion of the assembly E2, whereby the chocks of the intermediate roll 3' and of the lower carrying roll 2' rest on their respective rails whereas the lower working roll 4' is maintained at the same level and picked up by the recess 35' of the carrying member 34.

Besides, it is advantageous to place the extractor device on an auxiliary carriage 25 enabling to ensure immediate replacement of the rolls but, in a simplified arrangement, the handling carriage 18 could carry a single extractor device 28, which could move axially.

On the other hand, when using an auxiliary carriage fitted with several boxes, each box should preferably be fitted with an extractor device. However, it would be possible to place on the handling carriage, a single extractor device arranged at a certain distance, to the right on FIG. 1, to enable the displacement of the auxiliary carriage and liable to work together, in turn, with either box of the lateral carriage.

However, such a device would be more cumbersome and its operation slower.

Besides, in the example represented, the carriage 42 carries two storage racks 40, 40' simply arranged on the frame 47. It is thus possible, using a grappling beam, to remove one of the storage racks in order to replace the set of rolls, whereby the other rack enables to make the operations according to the rolling programme. But we could also use a single storage rack, fitted with a sufficient number of locations for the working rolls.

Moreover, as stated above, it is possible, if required, to remove and to replace a single working roll or a single insert.

In such a case, we could use a storage rack with a single rest bar of adjustable level to ensure the replacement of a single working roll.

On the other hand, the invention is especially suited to the replacement of the working rolls alone or of the complete inserts in a 'Z-High' type mill, but can also be used in any mill using to rolls free of chocks.

The reference signs inserted after the technical features mentioned in the claims solely aim at facilitating the understanding thereof and do not limit their scope in any way.

What is claimed is:

1. A device for changing rolls in a stand comprising, on either side of a running plane of a band to be rolled:

two working rolls with parallel axes, respectively upper and lower working rolls, delineating an air gap for the passage of the band, wherein each working roll is extended, at one end at least, by a journal, two backing-up assemblies, respectively, for each working roll, comprising each at least one intermediate roll, each having an axis, adjustment means for adjusting levels in relation to the axis of each roll with respect to the stand and delineating four levels of disassembly, respectively of both working rolls and of both intermediate rolls for which each working roll is moved away from the corresponding intermediate roll, two pairs of rails parallel to the axes of the rolls, arranged on the stand at two constant levels on which rest, respectively, each at a level of disassembly, both intermediate rolls, respectively upper and lower intermediate rolls, each via sliding carrying members for the removal of the corresponding intermediate roll, the roll changing device comprising:

a handling device placed on one side of the stand and comprising of at least one handling and guiding chassis on which provided two pairs of rails aligned respectively with both pairs of rails of the stand, at least one extractor device mounted to slide at a constant level on the guiding chassis, parallel to the axes of the rolls and movable between a close position of the stand for the disassembly and for the reassembly of the rolls, and an away removal position of the rolls inside the chassis, means to pick-up each working roll comprising a carrying member mounted on the extractor device and fitted with two recesses centered respectively on two axes spaced by a constant distance equal to the distance between the disassembly levels of both working rolls, wherein the level of the carrying member is adjusted so that, in the close position of the extractor device, each recess is centered on the axis of each working roll at the disassembly level and engages in a removable way, on the journal of the corresponding working roll by axial displacement of the extractor device, wherein the means for adjusting the level of each working roll in order to pick-up, in a cantilever way, said working roll using the carrying member delineating, after engagement of the journal, a relative vertical displacement of the latter with respect to the corresponding recess, removable means for hooking each of both intermediate rolls, provided on the extractor device and actuated selectively for the control of the disassembly and of the reassembly of each intermediate roll, by axial displacement, in the corresponding direction, of the extractor device, while sliding on the aligned rails.

2. A device according to claim 1, wherein the carrying member comprises a single part in which are provided two cylindrical bores each constituting a recess into which engages an end portion of the journal, whereby each bore is extended, at a lower section thereof on the roll side, by a protruding section, in the shape of a semi-cylindrical cradle and on which rests, in pick-up position, the remaining section of the journal.

3. A device according to claim 1 wherein each working roll is placed inside an insert comprising two lateral carrying assemblies supported by the intermediate roll, wherein the extractor device determines, selectively, using removable hooking means, the assembly and the reassembly of each insert, wherein the working roll is picked up, at a removal level, by the carrying member and the intermediate roll sliding, together with the corresponding lateral carrying assembly on the aligned rails.

4. A device according to claim 1, wherein the lower working roll rests in disassembly position on the lower intermediate roll, said lower intermediate roll is connected to means for adjusting the level thereof with respect to the stand, and the level adjustment of the working roll for centering the axis of the working roll on the axis of the corresponding recess and the picking-up by the carrying member is performed by adjustment of the level of the lower intermediate roll.

5. A device according to claim 1, wherein the extractor device is fitted with removable hooking means working together with sections interconnected axially with each intermediate roll to control selectively the sliding motion of said intermediate roll on corresponding rails under the action of the extractor device.

6. A device according to claim 1, further comprising at least two guiding chassis each associated with an extractor device and mounted side by side on an auxiliary carriage displaceable perpendicular to the axes of the rolls, for the placement of either said chassis in replacement position with the alignment of the corresponding rails with the rails of the stand, wherein one of the chassis is entirely empty initially for the reception of worn rolls and wherein at least the extractor device associated with the other chassis is loaded in advance with new rolls to ensure almost immediate replacement.

7. A device according to claim 1, further comprising a main handling carriage supporting at least one guiding chassis associated with at least one extractor device and mounted to move with respect to the roll stand, on fixed rails parallel to the axes of the rolls, between a replacement position in contact with the roll stan and a maintenance position away from the stand.

8. A device for changing rolls according to claim 1, further comprising a storage rack comprising at least one rest bar on which are provided at least two locations for depositing working rolls each fitted with a pair of cradles at a certain distance from one another, centred on an axis parallel to the axes of the rolls of the stand, for depositing, onto said rest bar, a working roll provided, at both ends thereof, with two journals resting onto said cradles at a distance from another, wherein one of said locations is free for depositing a worn working roll and the other of said locations is occupied by a replacement roll.

9. A device according to claim 3, wherein the stand is fitted with removable backing-up means for backing-up, at least, the upper working roll, displaceable between a position for backing-up of said roll at the disassembly level and a retracted position, the picking-up of said working roll by the carrying member being performed while placing the backing-up means in their retracted position, after engagement of the corresponding recess on the journal of the working roll.

10. A device according to one of claims 3 or 5, wherein the hooking means comprise two fingers mounted to slide transversally to the axes of the rolls on the extractor device, wherein the latter can be inserted between both intermediate rolls and means for controlling the motion of one finger at least for hooking at least one intermediate roll by engagement of said finger into a matching hole provided on a hooking section interconnected axially with the corresponding intermediate roll.

11. A device according to claim 6, wherein said one chassis is a first chassis which is initially entirely empty, for the reception, at least, of the worn working rolls removed from the stand by the extractor device associated with said first chassis and wherein said other chassis is a second chassis which is loaded initially with two new working rolls carried by the extractor device and two intermediate rolls carried by the rails of said second chassis for selective replacement, by the extractor device, of the rolls removed from the stand.

12. A device according to claim 7, further comprising at least two guiding chassis each associated with an extractor device and supported by an auxiliary carriage which is mounted to slide on the main handling carriage perpendicular to the axes of the rolls, between at least two positions, respectively, a position of alignment of the rails of each guiding chassis with the rails of the stand, wherein the other guiding chassis is moved away from the stand.

13. A device according to claim 12, wherein the main handling carriage comprises a platform on which is mounted to slide the auxiliary carriage and a linking section placed at one end of the main carriage oriented toward the roll stand and comprising two lateral stanchions on which are mounted rail sections arranged in the alignment of the rails of the stand and on which are aligned the rails of each guiding chassis by displacement of the auxiliary carriage.

14. A device according to claim 8 wherein the storage rack is mounted on a carriage movable on rails perpendicular to the axes of the rolls and passing in front of the handling carriage at a distance from the handling carriage, in order to arrange selectively each location for depositing rolls, in a loading or unloading position centered on a median plane of the extractor device.

15. A device according to one of claims 8 or 14, wherein the storage rack comprises two superimposed rest bars each carrying at least two adjacent deposit locations, placed at two levels spaced by a distance corresponding to that between the axes of the working roll of the mill, whereby the deposit locations of both rest bars are superimposed in twos for simultaneous reception of a set of two working rolls.

16. A device according to one of claims 8 or 14, wherein the storage rack is mounted on a chassis mobile in height and associated with means for raising the chassis with respect to the carrying member so that the storage rack picks up at least one worn working roll, also used for lowering the chassis so that the carrying member picks up at least one replacement roll situated on the storage rack.

17. A process for changing rolls in a roll stand having plural working rolls, comprising providing each working roll of the roll stand in an insert, said insert including an intermediate roll rotating on two chocks, two lateral carrying assemblies supported by said chocks, and means for removable support of the working rolls, operating an extractor device selectively for the disassembly and the reassembly, either of both working rolls, or of an assembly of said insert with the corresponding working rolls, the extractor device sliding at a constant level, the working rolls being held at a fixed disassembly level by a carrying member of the extractor device and a remaining portion of the insert being supported by rails and slides on the rails under the effect of the extractor device, removing rolls which are worn from use from the roll stand onto a handling carriage, retracting the handling carriage to a maintenance position, positioning a storage rack in front of a handling carriage, moving forward only the carrying member of the extractor device in order to place the worn working rolls above the storage rack, lifting the storage rack with respect to the carrying member in order to pick up the worn working rolls resting by their journals on two cradles spaced from the storage rack, returning the carrying member to an original position in order to clear the rack, moving the rack laterally to center in a median plane of the extractor device, placing the extractor device adjacent said rack carrying replacement rolls placed in advance, moving the carrying member forward so that the picking up means engages on the journal of at least one replacement working roll, lowering the rack so that the carrying member picks up said replacement roll, returning said carrying member backwards in order to transfer said replacement roll onto the handling carriage, moving the rack aside laterally and moving the handling carriage to a close position of the stand ready for the insertion of the replacement roll into the roll stand.

18. A process according to claim 17, wherein, once the extractor device has transferred on the handling carriage the assembly consisting of at least one insert comprising a working roll, a corresponding intermediate roll and two lateral carrying assemblies and the handling carriage is retracted to a maintenance position, moving the carrying member alone forward in order to deposit the working roll on the storage rack while leaving the remaining portion of the insert on the handling carriage, performing maintenance and, if needed, replacing the intermediate roll and the lateral carrying assemblies on the carriage, then, after the carrying member has picked up at least one working roll, reinserting the working roll inside the corresponding insert, by displacement of the carrying member moving the storage rack away, returning the handling carriage to a position close to the stand for simultaneous insertion inside said stand of the whole insert with new working roll.

* * * * *

UNITED STATES PATENT AND TRADEMARK OFFICE

CERTIFICATE OF CORRECTION

PATENT NO. : 6,098,439
DATED : August 8, 2000
INVENTOR(S) : Lecrivain

It is certified that error appears in the above-identified patent and that said Letters Patent is hereby corrected as shown below:

Item [30],
Please delete -- October 10, 1997 [FR] France .....97 125705 and insert October 10, 1997 [FR] France .... 97 12705 --

Signed and Sealed this

Seventh Day of August, 2001

*Attest:*

Nicholas P. Godici

*Attesting Officer*

NICHOLAS P. GODICI
*Acting Director of the United States Patent and Trademark Office*